United States Patent [19]

Matthias, Jr.

[11] Patent Number: 4,620,326

[45] Date of Patent: Nov. 4, 1986

[54] ADJUSTMENT MEANS AND GARMENT

[75] Inventor: Dan W. Matthias, Jr., Philadelphia, Pa.

[73] Assignee: Mothers Work, Inc., Philadelphia, Pa.

[21] Appl. No.: 747,644

[22] Filed: Jun. 21, 1985

[51] Int. Cl.[4] ..... A41F 9/02

[52] U.S. Cl. ..... 2/221; 2/237

[58] Field of Search ..... 2/221, 237, 76, 220, 2/236

[56] References Cited

U.S. PATENT DOCUMENTS

| | | | |
|---|---|---|---|
| 1,034,353 | 7/1912 | Friedman et al. | 2/237 |
| 1,516,801 | 11/1924 | Weiner et al. | 2/237 |
| 2,661,468 | 12/1953 | Doll | 2/221 |
| 2,900,643 | 8/1959 | Varnhagen | 2/221 |
| 2,999,246 | 9/1961 | Rowan | 2/221 |
| 3,091,772 | 6/1963 | Hebras | 2/221 |
| 3,793,645 | 2/1974 | Kadison | 2/237 X |

FOREIGN PATENT DOCUMENTS

| | | | |
|---|---|---|---|
| 262673 | 12/1926 | United Kingdom | 2/221 |

*Primary Examiner*—H. Hampton Hunter

[57] ABSTRACT

An adjustable fastening means is provided, preferably for incorporation into a garment, which includes a circumferential band fabricated of three different band means including in at least one of said band means an elastic portion to form a novel adjustable fastening means, which when incorporated into a garment may provide for adjustment without causing wrinkles in the garment.

8 Claims, 5 Drawing Figures

ADJUSTMENT MEANS AND GARMENT

BACKGROUND OF THE INVENTION

1. Field of the Invention

The present invention is directed to a novel adjustable fastening means. More particularly, the novel adjustable fastening means may be incorporated into a garment which can then be used to provide a comfortable fit to accommodate various sizes either with respect to the adjustable fastening means itself of if combined with a garment, which may include pants, skirts, and the like. Even more particularly, an adjustable skirt is provided which is equivalent to a regular non-adjustable skirt, however, can in addition accommodate individuals with varying weight loss and gain including maternity and post delivery wearers.

2. Background and Objects of the Invention

Most fasteners and adjustment mechanisms today are fabricated with and require sophisticated fasteners which not only may be expensive but additionally may be difficult to use and cause confusion in their operation.

Moreover, when and if such adjustable mechanisms are incorporated in a garment or clothing, the difficulty, and confusion are further complicated, generally, by the close proximity with which the adjustable fastening mechanism rests, vis a vis various portions of the body at which such a mechanism may be present in the garment.

Furthermore, there is a long felt need in today's market place for adjustable fasteners and garments which not only provide garments which can be utilized under normal wear conditions but can also accommodate variously shaped individuals and any attendant weight variations including, for example those conditions which are usually prevalent in pregnancy and post maternity.

It is therefore an object of the present invention to solve all of the abovementioned problems and difficulties.

A further object is to provide an adjustable mechanism which is easy to use and requires no special fasteners or other complicated procedures.

Yet a further object of the present invention entails the use of the novel adjustable fastening means in combination with a garment to provide flexibility in adjustment and wear of the garment.

Still yet a further object of the present invention is to provide an adjustable garment which will accommodate variations in weight loss and gain yet have the appearance of a stylish garment throughout such variations and thus accommodate the individual under all such conditions.

Still yet a further object of the present invention is to provide in an adjustable fastening means, an elastic material that not only is hidden but requires no user adjustment or intervention in the regular use of the adjustable fastening means when utilized alone or in conbination with the garment.

Still yet an even further object of the present invention is to provide an adjustable skirt which can not only be worn under normal conditions but can be used during, for example, early maternity and after the baby is born, while providing a comfortable stylish looking garment.

Other objects and advantages of the present invention will become more apparent to those skilled in the art from the following description when read in conjunction with the accompanying drawings wherein

DETAILED DESCRIPTION OF THE PREFERRED EMBODIMENT

Figure 2:
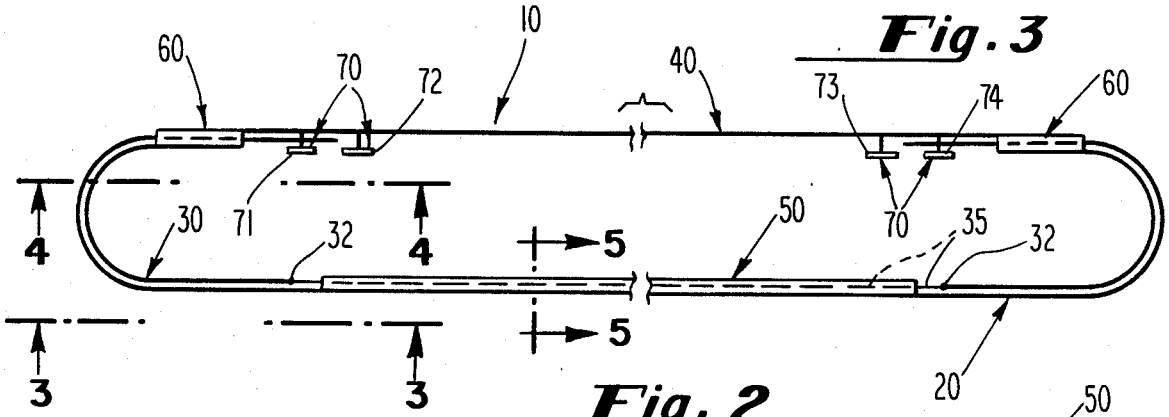
FIG. 2 is a plan view of the novel adjustable fastening means.

The present invention involves a novel fastening means 10, as is best shown in FIG. 2, comprising a first or exterior band of material 20, a second generally interior band of material 30 which in the preferred embodiment in part contains elastic material 35, a third band of material 40, a first or frontal tube of material 50, tubes 60, generally fabricated of a ribbon material or an appropriate alternative material as would be known in the art, and fasteners 70.

Figure 1:
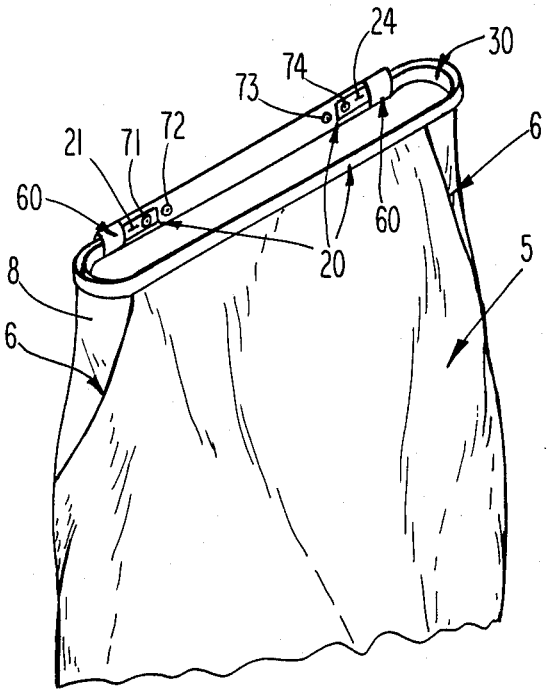
FIG. 1 is a perspective view of the novel adjustable fastening means as incorporated in a skirt.

As is best shown in FIG. 1, the novel fastener means 10 of the present invention can be incorporated into a skirt 5 which incorporation can be designed to form pockets 6 (see FIGS. 1, 3, 4), while retaining the fully adjustable and novel features as are fully explained and should be understood from a reading of this application.

Specifically and with reference to FIG. 2, novel adjustable fastening means 10 is fabricated of a first or frontal band of material 20, which in the preferred embodiment is not of an elastic nature. First band 20, however, can be fabricated of any suitable material, whether elastic or not, to accommodate various applications aside from the specific application as set forth in the preferred embodiment herein. First band of material 20 has sown thereto first tube means 50 which is preferably comprised of a soft material having an exterior face 51 which is looped forming generally U-shaped portion 52 and rear face 53 with both the exterior face 51 and rear face 53 being affixed with each other at point 54 by stitching or tacking the material, or in any appropriate manner as may be required by the end use of adjustable fastening means 10. When adjustable fastening means 10 is utilized in connection with skirt 5 as in the preferred embodiment, skirt 5 may be interposed between exterior surface 51 and interior surface 53 of first tube means 50 at point 54 in a manner which affixes not only both surfaces of first tube means 50, but affixes therebetween or therewith the garment to be used in connection with adjustable fastening means 10.

Figure 4:
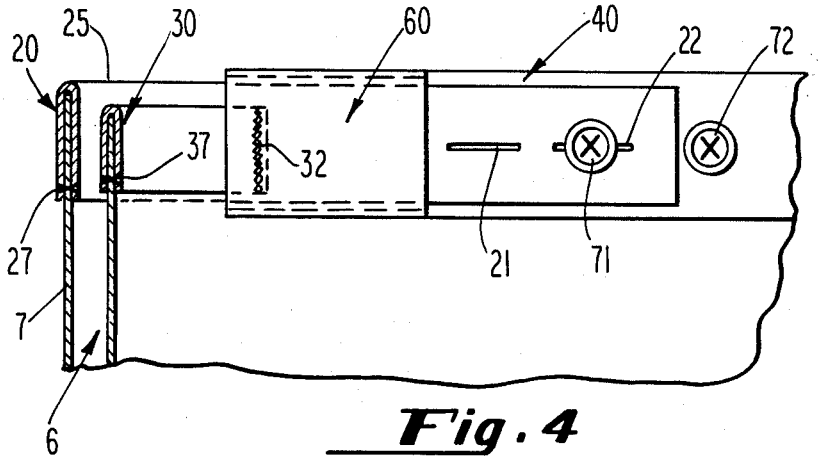
FIG. 4 is a partial sectional view taken along the lines 4—4 as shown in FIG. 2.
Figure 5:
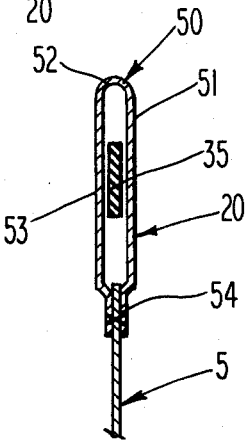
FIG. 5 is a sectional view taken along the lines 5—5 as shown in FIG. 2.

As is shown in both FIGS. 2 and 5, second band means 30 hereinbefore described as interior band of material 30, contains elastic material 35 between points 32, which material is guided by first tube means 50 and is permitted to freely pass and move therethrough as is best shown in FIG. 4. Second tube means 30 is attached by stitching 32 to second tube means 60. In the preferred embodiment adjustable fastener 10 includes two second tube means 60, both of which are in turn attached to third band means 40, by stitching same thereto or in any other satisfactory manner in accordance with the use of novel adjustable fastening means 10. Second tube means 60 is generally fabricated of a ribbon material and forms a tubular member through which first band means 60 travels, providing guidance therefor, while permitting non-restricted guided movement.

In the preferred embodiment fasteners 70, which are affixed with third band means 40, are buttons 71, 72, 73, 74, as are known in the art, but are preferably fabricated in a manner which maximizes comfort to the wearer. As is best seen in FIG. 4, first band means 20 contains openings 21 and 22 which provide means matable with fastening means 70 of third band means 40, to, for example, provide openings through which buttons 71 or 72 or both may be passed and secured, thereby fixing the location of first band means 20, vis a vis third band means 40. It should be understood that the first band means 20 likewise includes two other button holes (See FIG. 1) which function in the same manner as was heretofore described in connection with botton holes 21 and 22 in connection with buttons 73 and 74 of fastening means 70.

Figure 3:
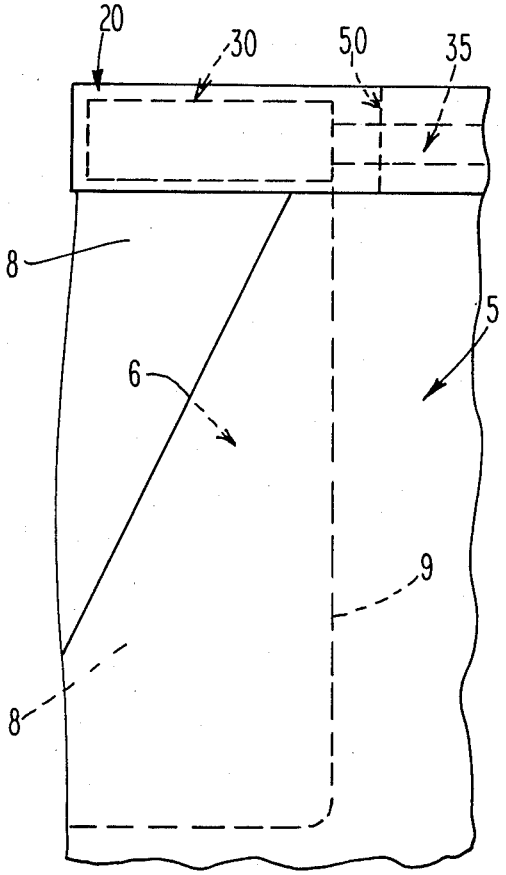
FIG. 3 is a partial sectional view taken through the lines 3—3 in FIG. 2.

With reference now to FIGS. 1, 3 and 4, incorporation of adjustable fastening means 10 into skirt 5 is now shown in a manner which fabricates pockets 6 in the garment, while maintaining the requisite advantages as set forth herein. In the preferred embodiment first band means 20 comprises a suitable material, which is folded over onto itself to form a generally U-shaped top-section 25 between which a portion of skirt 5 may be interposed and then secured by stitching 27. In the same manner, a portion of skirt 5 (designated as 8) is affixed to second band means 30 at stitching 37 with this portion additionally being affixed to skirt 5 along the dotted line shown in FIG. 3 (designated as 9) to form pockets 6. The rear of the skirt (not shown) is affixed to third band means 40 in the same manner as the skirt is affixed to first band means 20 as is known in the art.

In operation of the adjustable fastening means 10 first band means 20 can be secured to fastening means 70 in a manner which provides the smallest circumferencial waist band for skirt 5 which can be used to accommodate the individual in the regular wearing of skirt 5. Upon weight gain and/or protrusion of the waste section of the individual, elastic second band means 30 provides for expansion up to and including that amount which is set circumferentially by attachment of first band means 20 as determined by the fastening point with fastening means 70. Throughout this regular period and the period encompassing the slight protrusion of the stomach, elastic second band means 30 functions additionally to maintain skirt 5 in a fixed but comfortable position about the waist of the individual wearing the garment. As further weight gain and/or stomach protrusion occurs it may become necessary to increase the circumferential expandability of first band means 20 by adjusting same and particularly by selecting various points at which first band means 20 is secured with fastening means 70 to permit the necessary expandability of skirt 5 and particularly, adjustable fastening means 10 about the waist of the wearer. The construction of first tube means 50 and second tube means 60, provides second band means 30 and first band means 20 to respectively move freely throughout the looped portions of the first and second tube means. This aids in the adjustability and comfort provided by adjustable fastening means 10 and allows it to accommodate weight gain and/or weight loss, stomach and mid section protrusion and/or contraction, without immediately requiring adjustment of the circumferential expandability of adjustable fastening means 10 by changing the location of attachment of first band means 20 with fastening means 70.

It will be noted however that when adjustment of first band means 20 becomes necessary that the variation of the placement of first band means 20 about fastening means 70 does not cause skirt 5 to wrinkle or become pleated since such a variation merely changes the size of pockets 6 by virtue of the novel interrelation between adjustable fastener means 10 and skirt 5 as understood from the description set forth hereinbefore in connection with FIG. 4.

As will also be understood from a thorough review of the patent application when considered with the drawing figures and claims herein, adjustable fastening means 10 may be utilized in a variety of applications apart from those described in the preferred embodiment. Moreover, it should be understood that such adjustable fastening means 10 with minor modifications has applicability to any number of different types of garments for men, women and children and the like and therefore, it is be understood that the form of the invention shown herein and described is to taken only as a preferred example of the present invention and that various changes and modifications may be made without the departing from the scope of the invention.

What is claimed is:

1. Fastening means forming an adjustable circumferential band for use in conjunction with a garment, said garment consisting of a first portion of material and a second portion of material which partially overlaps said first portion of material, said first and second portions of material being affixed to form a pocket in said garment, said fastening means comprising: first band means; second band means; and attachment means for securing said first band means with said second band means, wherein said second portion of material is affixed to said first band means, said first portion of material is affixed to said second band means, said second band means in operative engagement with said first band means, whereby said garment, including said pocket, is maintained in smart, fitted, unwrinkled relation, irrespective of the location at which said first and second band means are secured by said attachment means.

2. Fastening means as in claim 1, wherein said second band means forms a circumferential band and said first band means forms a partial circumferential band secured with said second band means by said attachment means, whereby adjustment of said adjustable circumferential band is made by changing the location at which said first band means is secured with said second band means which changes the amount said second portion overlaps said first portion and the dimension of said pocket.

3. Fastening means as is claim 2, wherein said first band means further includes first guide means and said second band means further inclues second guide means, said second band means being slidably guided by said first guide means, said first band means being slidably guided by said second guide means.

4. Fastening means as in claim 3, wherein said second band means further includes elastic means located proximately with said first guide means.

5. Fastening means as in claim 2, wherein said second band means includes first and second openings, said first band means passing through said openings for attachment with said second band means.

6. Adjustable fastening means as in claim 5, wherein said second guide means includes first and second tube means, said second band means further including third band means wherein said second attachment means are included in said third band means and said second and third band means are affixed with said first and second tube means in a manner whereby said first band means slidably passes into and through and is guided by said first and second tube means.

7. Fastening means forming an adjustable circumferential band comprising: first band means including first guide means and first attachment means, second band means including second guide means having first and second openings and second attachment means, said second band means being slidably guided by said first guide means, said first band means and said first attachment means passing through said openings in said second band means, said first band means being slidably guided by said second guide means, whereby said first and second attachment means may be secured with each other in various locations without wrinkling or causing said fastening means to become pleated.

8. Fastening means as in claim 7, wherein said second guide means includes first and second tube means, said second band means further including third band means wherein said second attachment means is included in said third band means and said second and third band means are affixed with said first and second tube means in a manner whereby said first band means slidably passes into and through and is guided by said first and second tube means.

* * * * *